United States Patent [19]

Russell

[11] Patent Number: 4,478,011

[45] Date of Patent: Oct. 23, 1984

[54] HAND SANDER

[75] Inventor: Richard H. Russell, Farmington, Conn.

[73] Assignee: Norton Co., Worcester, Mass.

[21] Appl. No.: 557,384

[22] Filed: Dec. 1, 1983

Related U.S. Application Data

[63] Continuation of Ser. No. 289,448, Aug. 3, 1981, abandoned.

[51] Int. Cl.[3] ..... B24B 17/00

[52] U.S. Cl. ..... 51/360; 51/393

[58] Field of Search ..... 15/231, 232; 51/335, 51/359–361, 391–393

[56] References Cited

U.S. PATENT DOCUMENTS

| | | | |
|---|---|---|---|
| 123,888 | 2/1872 | Gernez | 51/361 |
| 752,475 | 2/1904 | Smith | 51/392 |
| 840,982 | 1/1907 | Williams | 51/360 |
| 1,320,299 | 10/1919 | Wilson | 51/361 |
| 1,946,562 | 2/1934 | Wurfschmidt | 51/360 |
| 1,947,054 | 2/1934 | McReynolds | 51/360 |
| 2,102,745 | 12/1937 | Read | 51/361 |
| 2,248,884 | 7/1941 | McAdams | 51/360 |
| 2,252,190 | 8/1941 | McAdams | 51/360 |
| 2,435,335 | 2/1948 | Andrews | 51/361 |
| 2,446,134 | 7/1948 | Hill | 51/360 |
| 2,459,893 | 1/1949 | Peterson | 51/360 |
| 2,472,899 | 6/1949 | Hein | 51/360 |
| 2,489,005 | 11/1949 | Bourdunis | 51/361 |
| 2,492,602 | 12/1949 | Stenberg et al. | 51/360 |
| 2,670,579 | 3/1954 | Applegate | 51/384 |
| 2,743,558 | 5/1956 | Hagadorn | 51/361 |
| 2,802,313 | 8/1957 | Bleam | 51/360 |
| 2,995,877 | 8/1961 | Richmond | 51/360 |
| 3,034,267 | 5/1962 | Feeney | 51/360 |
| 3,545,138 | 12/1970 | Houston | 51/361 |
| 3,727,351 | 4/1973 | Hughes | 51/361 |

FOREIGN PATENT DOCUMENTS

| | | | |
|---|---|---|---|
| 7811397 | 5/1980 | Netherlands | 51/391 |
| 677068 | 8/1952 | United Kingdom . | |

*Primary Examiner*—Harold D. Whitehead
*Attorney, Agent, or Firm*—Allan R. Redrow

[57] ABSTRACT

A sanding block structure having storage means for an elongated strip of abrasive material and including a pusher for driving a portion of the abrasive strip over a work piece is shown wherein the storage means for the abrasive strip and the working surface for engaging the abrasive against the work are carried on a cassette structure that is readily separable as a unit from the pusher.

5 Claims, 6 Drawing Figures

HAND SANDER

This application is a continuation of U.S. patent application Ser. No. 289,448, filed Aug. 3, 1981, now abandoned.

FIELD OF THE INVENTION

This invention relates to a sanding block having a storage chamber for containing a rolled strip of abrasive material from which a fresh piece of the abrasive strip may be withdrawn for mounting over a working surface, the supply means being designed in the form of a readily replaceable cassette means for attachment to the pusher means provided for reciprocating the sanding block.

PRIOR ART

Typical patents showing the state of the art are the following:

U.S. Pat. Nos. 123,888; 752,475; 1,320,299; 1,946,562; 1,947,054; 2,102,745; 2,248,884; 2,252,190; 2,446,134; 2,459,893; 2,472,899; 2,489,005; 2,492,602; 2,670,579; 2,743,558; 2,802,313; 2,995,877 and British Pat. No. 677,068. All of these publications show a sanding block including a pusher means having a storage chamber for a rolled up strip of coated abrasive material and a bearing surface for supporting the strip in engagement with the surface to be abraded. Means are shown to hold the strip taut after it has been drawn over the bearing surface so that from time to time a fresh length of the strip may be pulled into position over the bering surface as the abrasive strip becomes worn. Various means are shown for holding the coiled supply in position to permit the end portion of the strip to be drawn from the supply and positioned over the bearing surface that cooperates with means to lock the strip in place on the bearing or working surface that presses the abrasive against the work. In these known devices, whenever a change in grit size of the abrasive on the strip or a strip coated with an alternate type of abrasive grit is desired, it is necessary to remove the supply coil from the storage means on the sanding block, roll it up and store it in any available storage means from which it must be retrieved and repositioned in its storage chamber on the pusher for further use. The desired strip of abrasive material placed in the chamber may then be moved into position over the working surface.

BRIEF DESCRIPTION OF THIS INVENTION

This new structure provides a storage chamber for a roll of abrasive material in a cassette having an integral support for the bearing or working surface on which the withdrawn end of the abrasive strip is mounted, the cassette including the supply chamber and working surface being adapted for quick mounting as a unit on a pusher means for the sanding block. The pusher may be either a power driven element or a handle for manual manipulation of the abradant over the surface against which the abrasive action is directed.

The cassette provides a storage means for the elongated ribbon of abrasive that is usually supplied in roll form. The ribbon may be a plain paper or cloth back abrasive or it can be coated on its back side with a pressure sensitive adhesive. The ribbon storage means is formed integral with a bearing means that supports the working surface over which the ribbon is held stretched to be pressed against the work when the pusher is reciprocated. When the ribbon in the storage chamber is made with a pressure sensitive adhesive on its back and a length of this ribbon is drawn from the storage the withdrawn end may be adhered to the bearing surface and when this cassette is attached to a pusher the tool is ready for use. When a plain ribbon is stored in the cassette, a supply and take-up storage means is utilized. The bearing means that is integral with the storage means has a working surface that is generally elongated and in one form of the invention extends from the supply chamber at one end to the take-up chamber at the other end thereof so that the ribbon can be stretched from one end to the other end of the cassette over the working surface of the bearing means.

The pusher and cassette are designed to operate as a unit and the pusher includes mounting means for the cassette to properly expose the working surface of the bearing means for use against the work to be abraded. The supply and take-up chambers have apertures through which the ribbon of abrasive material is drawn and in the case of the plain backed ribbon the pusher means has a brake or locking means for cooperating with the opposite ends of the length of the ribbon that has been drawn from the supply to hold the ribbon taut and tightly engaged on the working surface.

IN THE DRAWINGS

DETAILED DESCRIPTION

Figure 1:
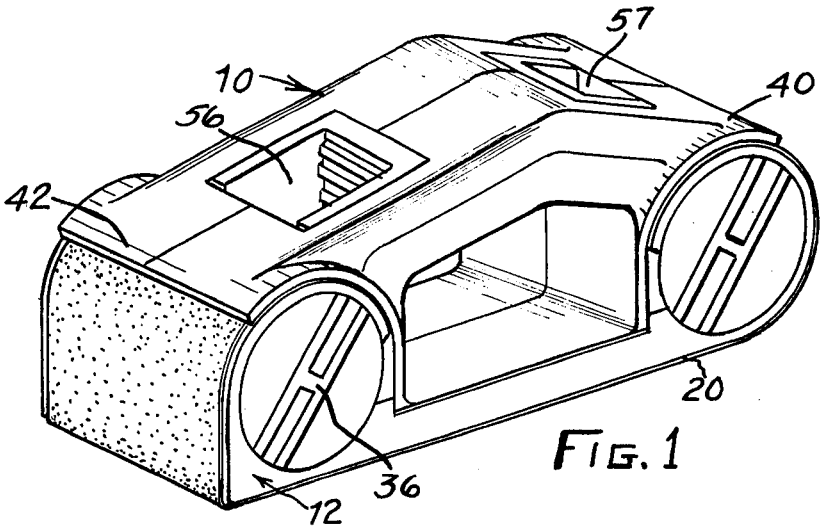
FIG. 1 is a perspective view showing the cassette ribbon storage means mounted on a manually driven pusher means.
Figure 2:
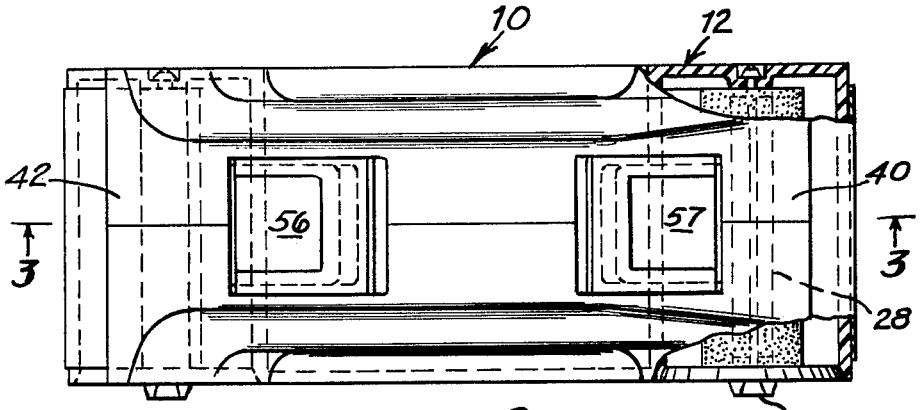
FIG. 2 is a top plan view of the sanding block of FIG. 1.
Figure 3:
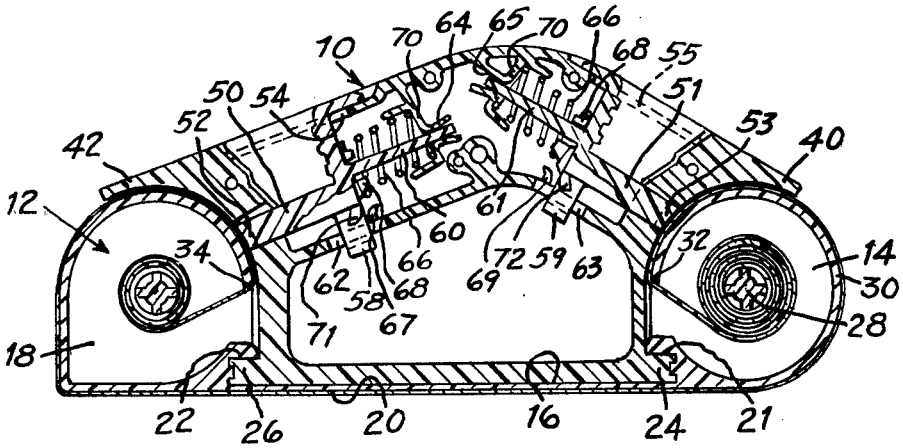
FIG. 3 is a sectional side elevation of the assembly taken on the plan 3—3 of FIG. 2.
Figure 4:
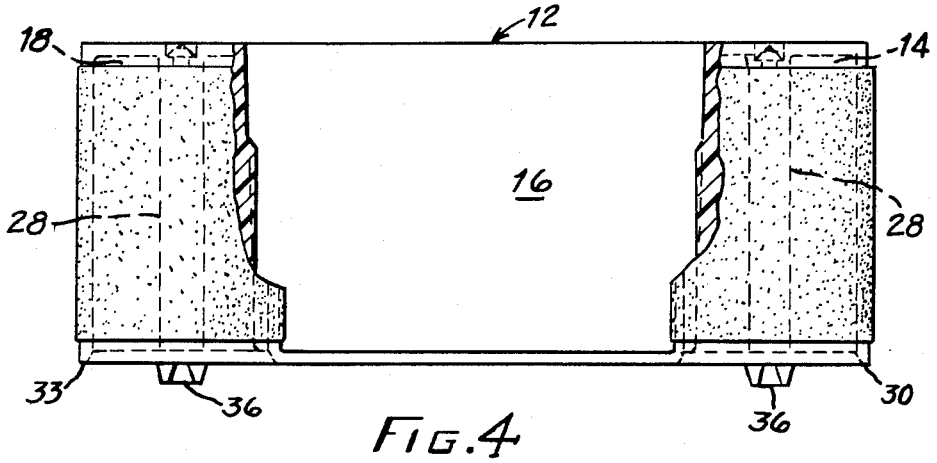
FIG. 4 is a top plan view of the cassette, partly broken away.
Figure 5:
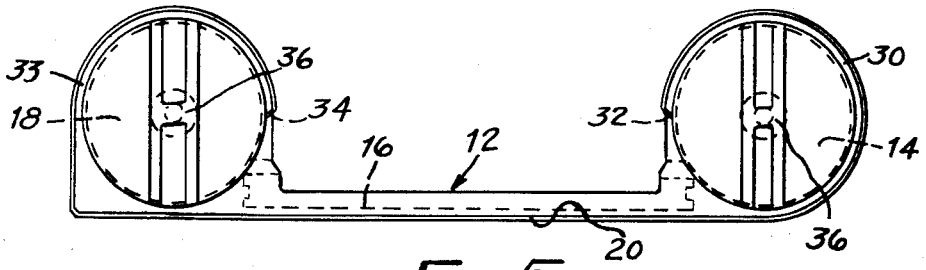
FIG. 5 is a side elevation of the cassette shown in FIG. 4.

In FIG. 1, a sanding block is shown that has a manual pusher means 10 that has integral mounting means for supporting a cassette 12. The cassette is removably supported on the pusher means and may be made as a plastic assembly, as best seen in FIG. 3 having a supply chamber 14 at one end of an integral bearing means 16 and a take-up chamber 18 at the other end thereof. In the preferred form of the invention the supply chamber is adapted to hold a rolled up strip or ribbon of abrasive material and the take-up chamber 18 is also shaped to store the strip in roll form. In order to lay the abrasive strip over the working surface 20 on the bearing means, the end of the ribbon of abrasive material is pulled from the supply chamber, passes over a working surface 20 on the bottom side of bearing means 16 and is then wound on the take-up reel in chamber 18.

As above stated the cassette is designed for quick attachment to and removal from the pusher means and for this purpose has tapered C shaped female track elements 21 and 22 positioned at the opposite ends of the bearing means 16 at the junctions of the bearing means with each of the supply and take-up chambers 14 and 18 respectively. These tracks cooperate with corresponding tapered male track elements 24 and 26 molded integral with the pusher 10. The tracks are disposed transversly of the predominant direction of reciprocation of the pusher element and thus the cassette may be slid into position and frictionally engaged on the pusher means by reason of the cooperating tapered track elements 21 and 24, and 22 and 26.

In one form of the invention, the supply chamber 14 of the cassette 12 is designed to contain a roll of abrasive ribbon material having a plain cloth or paper backing. The abrasive roll may be carried on a suitable spindle 28 or it may be loosely positioned in this supply chamber within the confines of the peripheral wall 30. The free end of the ribbon of abrasive material is fed through aperature 32 in wall 30, adjacent the juncture of the bearing means 16 with the integral supply chamber, and the withdrawn end of the ribbon passes entirely around the outer surface of wall 30, over the face of the working surface 20 of the bearing means, around the peripheral wall 33 of the take-up reel chamber 18 and in through aperature 34 to be wound up on spindle 28 in the take-up chamber. Suitable key means 36 may be provided on the ends of the spindles 28 for rotating them to feed an end portion of the ribbon from the supply chamber and draw it into the take-up chamber to be wound up on spindle 28 of the take-up reel.

The cassette with the ribbon of abrasive material drawn over the working face 20 of the bearing means 16 is mounted on the tracks 24 and 26 of the pusher that can be reciprocated in contact with the work for pressing the abrading ribbon against the object being worked on. It is apparent that the cassette may be slid onto tracks 24 and 26 and withdrawn from these tracks at any time to change the abrading material at any time, without disturbing the draping of the abrasive ribbon over the working face 20 of the bearing means. The pusher is shaped to receive the cassette within hoods 40 and 42 integral with the opposite ends of the body of the pusher to provide a smooth upper surface and handle area for manually engaging this form of the sanding block. In some instances the pusher may be driven by means not shown to provide a reciprocating power driven pusher means such as in an orbital sander or other driven means.

The body of pusher 10 shown in FIG. 1 may be formed of several cast plastic parts that may be assembled together to receive the different cassettes that may be mounted on the pusher one after the other, wherein each different cassette may be provided with a different type of grit or grit size on the abrasive ribbon designed to produce a specific abrasive action against the work piece being abraded. The center portion of the pusher body may be hollow if desired to provide a convenient hand hold for manual operation of the sanding block or for providing a suitable drive connection with a source of reciprocating power.

When a roll of plain cloth or paper back abrasive strip is stored in the cassette for delivery across the working face of the sanding block, brake means are provided to cooperate with the end of the ribbon withdrawn from supply chamber 14 and rolled up in storage chamber 18 which ribbon is laid over surfaces 30 and 33 of the cassette. For this purpose, as shown in FIG. 3, the pusher 10 is provided with identical reciprocating plunger elements 50 and 51, each having a nose 52 and 53 respectively. Each plunger is resiliently urged to engage these nose elements, the one against outer wall 30 of the supply chamber 14 above the aperture 32 and the other against the wall 33 of the take-up chamber 18 above aperture 34. The plungers are slidably mounted on ways 54 and 55 that define apertures 56 and 57 in the upper surface of pusher 10. Each plunger body is a molded plastic element having a downwardly extending combined guide bearing means 58 and 59 and brake latching tongues 71 and 72. The latching tongues 71 and 72 are integral with the plunger body and each tongue has a cam shape on one side to ride up over cooperating stops 67 and 69. Each plunger also has an integral rearwardly extending guide tongue 60 and 61. Guide bearings 58 and 59 cooperate with slots 62 and 63 formed in a central structural wall in the center of pusher 10 and the tongues 60 and 61 engage in bearing slots 64 and 65 that are also formed in internal webs within the pusher body 10.

The tongues 60 and 61 of each plunger is surrounded by a coil spring 66 centered on a seat 68 integral with the plunger body, each spring has a bearing at its other end on a wall 70 to project the noses of the respective plungers 50 and 51 to bear against the outer surface of walls 30 and 33. Each of the nose pieces 52 and 53 has suitable bearing pads integral therewith to fit the contour of the walls 30 and 33 respectively, to engage the spaced apart portions of the withdrawn end of the ribbon firmly against these walls when springs 66 push the plungers toward the oppositely disposed outer ends of the pusher body. It is apparent that the plungers can be manually engaged through apertures 56 and 57 to be retracted against the tension of springs 66. When plunger 50 is retracted on way 54 guide bearing 58 slides in slot 62 until the downwardly extending tongue 71 rides up and over to become engaged behind stop 67 and in a similar manner plunger 51 may be retracted and held latched behind stop 69. The plungers can be held in their retracted positions while a fresh length of abrasive ribbon is pulled from the supply chamber and wound up in the take-up chamber while the cassette is either on or off of the pusher means. After the end of the ribbon has been drawn over the working surface 20 of the bearing means, the plungers 50 and 51 may be lifted slightly to release tongues 71 and 72 from behind stops 67 and 69 so that springs 66 and 68 can project the noses 52 and 53 against surfaces 33 and 30 to hold the opposite ends of the ribbon stretched taut over surface 20 by clamping the ends of the ribbon against these walls. It should be noted that the throats through which each of nose elements 52 and 53 are guided to bear against surfaces 33 and 30 respectively are somewhat V shaped with the open part of the V positioned to allow the plunger to raise up slightly as tongues 71 and 72 move over the stops 67 and 69.

Figure 6:
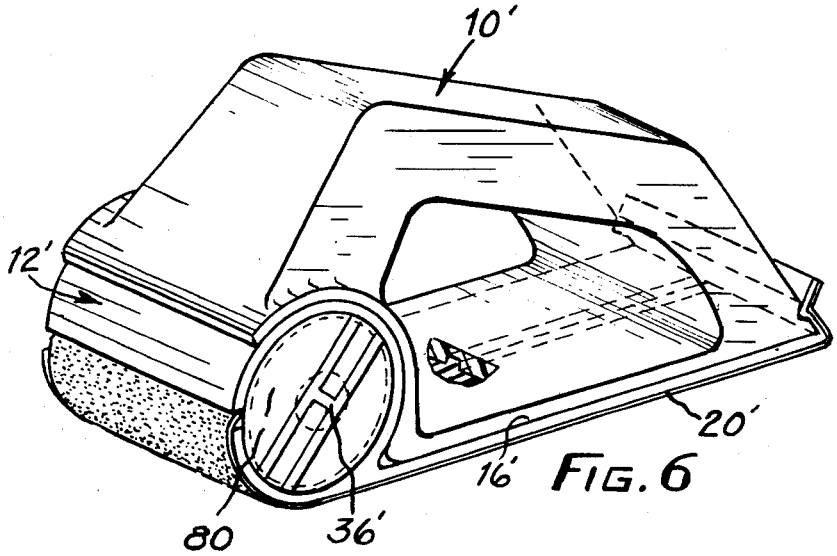
FIG. 6 is a perspective view showing a modified form of cassette and pusher combination.

In another form of the cassette shown in FIG. 6, a ribbon of abrasive material having a coating of pressure sensitive adhesive can be stored in storage chamber 80 either in a self sustaining roll or carried on a spindle 36'. When such a ribbon is used, the withdrawn end of the ribbon may be adhered to surface 20' of the bearing means 16' and the worn out end of the ribbon may be cut off. No storage chamber need be provided with this form of cassette 12'. When a cassette for the abrasive strip with a pressure sensitive adhesive is used, an alternate form of pusher 10' attachment may be used to assemble the cassette on the pusher as shown in the drawings, the under surface of this pusher is designed to interfit with a suitable resilient engaging element on the upper surface of the cassette for quick attachment and removal. Since pressure is always applied against the pusher to press the abrasive against the work, the fit between the cassette and the pusher can be a rather easy one to make as a snap fit since the cassette is always trapped between the work and the pusher when the sanding block is in use.

When either form of abrasive strip, plain backed or one with a pressure sensitive abrasive is used, with this invention it is seen that a removable cassette together with a pusher on which the cassette may be mounted, is shown that permits the quick interchange of cassettes to make the most productive use of a plurality of particular abrasive ribbons that may be made available for any given job. The type of ribbon needed at any stage of the abrading process may be mounted on the pusher and removed therefrom without any wastage since when needed again that cassette may be remounted on the pusher without disturbing the seating of the partially used up ribbon on bearing surface 20.

In certain operations it may be desired to roll the plain backed strip back over the working surface by rewinding it on the supply spindle to make use of a partially worn abrasive surface against the work. When the form of cassette here shown is used having both a supply and take-up storage chamber integral with the bearing means, the strip may be easily rolled back up into the supply chamber to pull a previously used section of the strip back into taut position over the working surface 20.

It is also possible to provide a roll supply having sections of abrasive grain with different grit size or different abrading characteristics. Such a supply of a multi-purpose ribbon is particularly suggested for use in a do-it-yourself mechanics work shop. Such a ribbon of abrasive can be easily color coded and stored in a multi-purpose cassette as here taught.

The preferred form of mounting a cassette on the pusher makes use of the sliding track arrangement described above. Other means may be used, however, wherein a Velcro hook and fastener system, or magnetic attraction, or alternate forms of key-way or dovetail structures are adapted for this purpose. As stated above, because the cassette is always positioned between the pusher and the workpiece when the abrading work is proceeding, the interconnection between the pusher and the cassette need be only sufficient to prevent relative movement of the pusher with respect to the cassette after the attachment is completed, but which permits an easy and quick separation when an interchange of cassettes is desired.

The cassette and pusher combination may be used for any abrading activity for which the ribbon abrasive may be used. The pusher may be driven either manually or by a power source such as the above suggested orbital sander pusher suggested above to effect the necessary relative rubbing action between the abrading means and the work. The pusher in some instances, however, may be held stationary while the work is pressed against and moved across the abrading ribbon held on the stationary working surface of the cassette as for example to sharpen a knife.

The abrading process can be performed with ribbons of abrasive material adapted for dry grinding operations or when the proper ribbon is carried in the cassette, a wet sanding action can be performed. When the block and cassette are made of plastic parts it is apparent that the parts can be selected so that the moisture or any other grinding lubricant or abrasion promoting or coolant liquids used will have no deliterious effect on the cassette or the pusher elements.

Means other than the simple manually rotatable spindles and brake means shown may be used to move the strip of abrasive over and hold the strip taut on the working surface. A more elaborate knob for driving a gear and intergeared connections to the winding spindles can be conceived. Other brake means also can be designed having a toggle or wedging effect to serve the brake function for holding the strip taut on the bearing means. All these and possibly other modifications of this invention may occur to those skilled in the art which will fall within the scope of the following claims.

What is claimed is:

1. A sander including a pusher element and a supply means for holding a strip of coated abrasive, which abrasive strip has front and back sides, and from which a fresh length of the strip may be drawn from time to time and held on the sander to expose the front side thereof for abrading an object and the used portion of the strip may be stored, said sander comprising a cassette having a pair of storage chamber means forming respectively a supply chamber and a take-up chamber for receiving said coated abrasive strip, said supply chamber holding the strip before the strip has been used and said take-up chamber serving for storing the strip after it has been used for abrading said object, said cassette having a thin rigid bearing means including a working surface, said working surface having front and back sides and said working surface extending lengthwise between said supply chamber which is at one end of the bearing means and said take-up chamber which is at the other end thereof, said bearing means being formed integrally with said pair of storage chamber means, each of said storage chamber means having means defining an opening through which said fresh strip may be drawn from said supply chamber and laid over said working surface and through which said used portion may be moved respectively into said storage chamber means, means to hold the back side of said withdrawn strip in contact with the front side of said working surface, means integral with the back side of said working surface to removably attach said cassette to said pusher, said attaching means including a pair of sliding track means integral with said pusher, a pair of cooperating sliding track means integral with said bearing means on the back side of said working surface, and each of the respective cooperating tracks of said pairs of sliding track means being disposed in spaced apart relation along to the back side of the length of said working surface, with one of said pair of track means respectively being positioned next to each of said storage chamber means at the opposite ends of the bearing means.

2. A sander as in claim 1 wherein each of said chambers are defined by a peripheral wall, each of said walls having means for defining said opening through which said strip may be drawn and laid over said bearing surface, and said pusher having a releasable brake means foı engaging the strip passing through said openings in the walls of said chambers.

3. A sander as in claim 2 wherein said brake means engages said strip against the respective peripheral walls of each of said chambers.

4. A sander including a pusher element and a supply means for holding a strip of coated abrasive, which abrasive strip has front and back sides, and from which supply a fresh length of the strip may be drawn from time to time and held on the sander to expose the front side thereof for abrading an object, said sander comprising the combination of two separable elements including said pusher and a unitary cassette structure, said cassette unit including an integral storage chamber means for receiving and storing the coated abrasive strip that is always carried in the storage chamber means, said storage chamber means including a supply chamber defined by a wall for storing fresh abrasive strip and a take-up chamber defined by a wall for storing used abrasive strip, said cassette having integral therewith a rigid bearing means including a working surface that extends between said supply chamber and said take-up storage chamber, said working surface having a front side and a back side, said supply chamber having means defining an opening in its wall through which said strip may be drawn and laid over the front side of said integral working surface, said take-up chamber having means defining an opening in its wall through which said used abrasive strip may be moved for storage in said take-up chamber, said pusher having an under surface adapted to be releasably interfitted and locked on said back side of said working surface, means supported on said pusher for cooperating with said cassette carried by the pusher to hold the back side of said withdrawn end of said strip taut and in contact with the front side of said working surface, said means to hold said strip taut including an engaging element adapted to press against said strip that is drawn from said storage chamber adjacent said opening in its wall to engage said strip immovably against said wall of said supply chamber and a second engaging element adapted to press against said strip adjacent said opening in the wall of said take-up storage chamber to engage said strip immovably against said wall of said take-up chamber.

5. A sander including a pusher element in combination with a supply means for holding a strip of coated abrasive, which abrasive strip has front and back sides, and from which supply a fresh length of the strip may be drawn from time to time and held on the sander to expose the front side thereof for abrading an object, said supply means comprising a cassette having storage chamber means that includes a pair of storage chambers forming respectively a supply chamber and a take-up chamber for receiving said coated abrasive strip, said supply chamber holding the strip before the strip has been used and the take-up chamber serving for storing the strip after it has been used for abrading an object, said cassette having a rigid bearing means including a working surface integral with said storage chamber means, said working surface on said bearing means extending lengthwise from said supply chamber at one end of the bearing means to said take-up chamber at the other end thereof, said supply means being formed integrally with said bearing means, said pusher having sliding track means integral therewith, and said cassette having cooperating sliding track means thereon adapted to be removably attached to said first named sliding track means, said track means on said pusher having a wedging engagement with said track means on said cassette.

* * * * *